United States Patent [19]

Jones et al.

[11] Patent Number: 4,703,328

[45] Date of Patent: Oct. 27, 1987

[54] WINDOW ANTENNA/HEATER ARRANGEMENT

[75] Inventors: David W. Jones, Southport; Malcolm Elston, Bury, both of United Kingdom

[73] Assignees: Pilkington plc, Merseyside; Salford Electrical Instruments, Limited, Lancashire, both of England

[21] Appl. No.: 694,784

[22] Filed: Jan. 25, 1985

[30] Foreign Application Priority Data

Jan. 27, 1984 [GB] United Kingdom ..... 8402244

[51] Int. Cl.[4] ..... H01Q 1/02

[52] U.S. Cl. ..... 343/704; 343/713; 219/203; 219/522

[58] Field of Search ..... 343/704, 711, 713, 712; 219/203, 522, 543

[56] References Cited

U.S. PATENT DOCUMENTS

| | | | |
|---|---|---|---|
| 2,944,926 | 7/1960 | Gaiser | 343/704 |
| 3,484,584 | 12/1969 | Shaw | 343/704 |
| 3,928,748 | 12/1975 | Sauer | 343/704 |
| 4,063,247 | 12/1977 | Sakurai et al. | 343/704 |
| 4,086,594 | 4/1978 | Kropielnicki et al. | 343/704 |
| 4,422,077 | 12/1983 | Kropielnicki | 343/704 |

FOREIGN PATENT DOCUMENTS

| | | | |
|---|---|---|---|
| 2635217 | 2/1978 | Fed. Rep. of Germany | 343/704 |
| 2735278 | 2/1978 | Fed. Rep. of Germany | 343/704 |
| 2050236 | 4/1971 | France | 343/713 |
| 50602 | 5/1981 | Japan | 343/704 |

*Primary Examiner*—William L. Sikes
*Assistant Examiner*—Michael C. Wimer
*Attorney, Agent, or Firm*—Burns, Doane, Swecker & Mathis

[57] ABSTRACT

A glass window for a vehicle, especially an automobile rear window carries a heater extending between a pair of spaced bus bars. The bus bars are connected to terminals on the window which are close together near a periphery of the window, preferably near the lower edge. The leads which connect the terminals to the bus bars are each fixed to a surface of the window and are sufficiently spaced from the window edge to reduce any stray capacitance to a level such that a useable radio signal is supplied to a radio receiver by a decoupling circuit connected between the heater terminals and a power supply.

11 Claims, 6 Drawing Figures

WINDOW ANTENNA/HEATER ARRANGEMENT

BACKGROUND OF THE INVENTION

This invention relates to a glass window for a vehicle of the kind having a heater extending between bus bars on a surface of the glass, usually the inner surface of the glass when the window is a rear window installed in an automobile. The heater may be an array of heating elements or an electrically conductive heating film on a surface of a single sheet window, or may be embodied within a laminated window construction.

Attempts have been made to provide such a window in which a heater array can also be used as a radio aerial which can be coupled to a radio receiver, but there have been problems of decoupling the radio frequency current from the direct current supplied by the power supply circuit of the vehicle. The direct current circuit is connected to the usual automobile DC power supply, one terminal of which is usually earthed, and which is liable to carry considerable noise signals.

Decoupling circuits suitable for installation in a vehicle have been developed for example as described in GB No. 1,520,030; GB No. 1,600,987 and U.S. Pat. No. 3,484,584. However there have still been problems because the conventional arrangement of a heater array is not particularly suitable for use as a radio aerial. Problems are caused by stray impedances between the heater array and the surrounding metal parts of the car body, in particular the capacitance between the leads which supply heating current to the heater array and the metal parts of the car body which frame the window, especially if the leads are not fixed.

A usual heater array on a rear window of an automobile comprises an array of fine electrical resistance heating elements which extend across the rear window between bus bars down the sides of the window. This array is printed onto the window using a conventional ink containing silver, pigment and glass frit which is printed onto the window and then fired.

It has been proposed to extend the bus bars down the sides of the window and along the bottom of the window for connection to the decoupling circuit. This has not proved satisfactory because of local overheating resulting in failure of a bus bar or damage to the glass, and uneconomic dissipation of power in the bus bars.

It has also been proposed to use a "folded" heater array in which the bus bar at one side is separated into two parts the nearer ends of which are close together and are separately connected to terminals for connection to the decoupling circuit, whilst the bus bar at the other side of the window simply interconnects all the heating elements. The heating elements are thus divided into an upper group and a lower group, with all the elements in each group connected in parallel, and the two groups connected in series across the terminals. This operates satisfactorily as a radio aerial, but the unconventional arrangement of the heater array necessitates the use of thicker conductors employing larger than usual amounts of relatively expensive, silver-containing ink. A disadvantage in some vehicles of having both the terminals near one side of the window is that the decoupling circuit, which has to be close to the terminals, has to be mounted in one of the rear pillars supporting the car roof. This may be difficult because of the bulk of the decoupling circuit, particularly in vehicles with tail gates.

OBJECT AND SUMMARY OF THE INVENTION

A main object of the invention is to enable heater arrays which are designed solely to give a desired heating effect, to be adapted to act as a radio aerial.

According to the invention there is provided a glass window for a vehicle comprising a heater extending between a pair of spaced bus bars which are intended for connection to a decoupling circuit which enables the heater to be used as a radio aerial, terminals arranged close together near the periphery of the window and between the bus bars, and leads which connect each terminal to a respective bus bar at least at one point spaced from the ends of the bus bar, which leads are fixed to a surface of the window but are sufficiently spaced from the window edge to reduce any stray capacitance to a level such that a useable radio signal can be derived.

Preferably the terminals are positioned near the lower edge of the window.

Each of the leads may be a single strand wire adhered to a strip of frit baked on to the window surface, and each lead may have a flat side to assist adherence to the strip.

Alternatively each lead may be a flat braided wire lead which is adhered to the glass surface.

The glass window may be an automobile rear window, the heater being an array of heating wires on a surface of the glass extending between the bus bars which are connected via the terminals adjacent the periphery of the rear window, to the decoupling circuit, so that the heater array on the rear windows is effective both as a heater and as a radio aerial.

The invention also comprehends a glass window of the invention fitted in a vehicle, with the heater terminals connected through the decoupling circuit to the power supply of the vehicle, and the decoupling circuit connected to a radio receiver in the vehicle. Further the invention includes a vehicle having a glass window according to the invention.

Some embodiments of the invention will now be described, by way of example, with reference to the accompanying drawings.

DETAILED DESCRIPTION OF THE PREFERRED EMBODIMENTS

Figure 1:
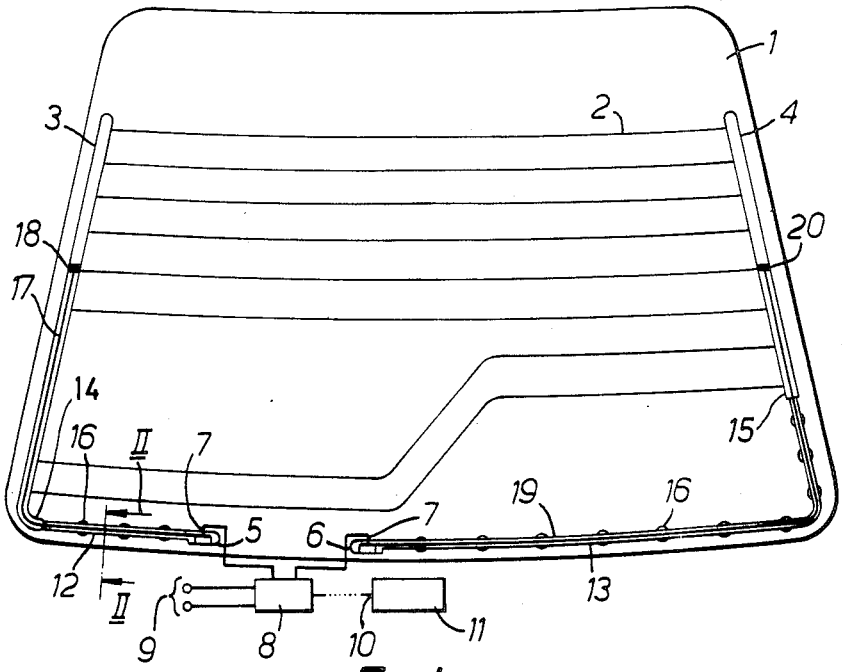
FIG. 1 is an elevation of an automobile rear window looking at the inside surface of the window.

FIG. 1 shows a glass window 1 for fitting as the rear window of an automobile. The window 1 has a heater array consisting of fine electrical resistance heating elements 2 which extend across the window in conventional manner between bus bars 3 and 4. The heater array of heating elements 2 and bus bars 3 and 4 are printed onto the inner face of the window using a conventional ink containing silver, a pigment, and a glass frit which is printed onto the glass which is then baked to provide the heater array. Near the lower edge of the window are terminals 5 and 6 which are for connection through T-connectors 7 to a decoupling circuit 8 which is mounted in the automobile body close to the terminals 5 and 6. The decoupling circuit 8 is connected to the electrical power circuit 9 of the automobile for the supply of heating current to the heater array and also has a connection to the aerial input 10 of a radio receiver 11 installed in the autmobile. For optimum impedance conditions, depending on the design of the vehicle body, important dimensions are the distance between the terminals 5 and 6, and the distance of the terminals 5 and 6 from the edge of the glass window, and more importantly from the edge of any metal part framing the window. It has been found that a spacing between the terminals 5 and 6 of from 50 mm to 300 mm is generally suitable.

The pattern printed and baked onto the inner surface of the window includes narrow strips of conductive frit 12 and 13 respectively extending around and spaced from the edge of the window and running into the ends of the bus bars 3 and 4. The narrow strip 12 runs into the curved end 14 of the bus bar 3 near to a lower corner of the window. The narrow strip 13 runs along the bottom of the window, turns upwardly along the window side and runs into the bus bar 4 at the bottom end 15 of that bus bar. The terminals 5 and 6 are not symmetrically placed on the window, for design reasons, but may be symmetrically placed if required. Alternatively the terminals could be placed adjacent the top of the window.

Figure 2:
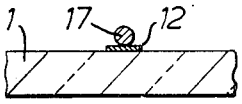
FIG. 2 is a section on line II--II of FIG. 1.

At spaced intervals along each of the narrow strips 12 and 13 there are enlarged patches 16 which provide a base for adhesion of an electrical lead to each strip. As shown in FIG. 2 there is a single-strand, tinned copper wire 17 which is connected to the connector 7 at terminal 5 and which is adhered to the strip 12 by being soldered to the strip 12 at each of the enlarged locations 16 on that strip. At its upper end the single strand lead 17 overlies the bus bar 3 and terminates at a T-shaped copper connector 18 of conventional design which is soldered to the centre of the bus bar 3. Where it overlies the bus bar 3 the lead 17 may be soldered to the bus bar or adhered using a hot melt adhesive.

In the same way there is a single strand tinned copper lead 19 soldered to the strip 13 leading from the connector 7 at the terminal 6 and leading over the end 15 of the bus bar 4 and up to a connector 20 which is soldered to the bus bar 4 opposite to the connector 18 on the bus bar 3. The lead 19 is similarly soldered or otherwise adhered to the bus bar 4.

Each of the leads 17 and 19 may be electrically connected to its respective bus bar 3 or 4, by soldering at more than one position, to avoid uneven distribution of current along the bus bar such as could give rise to local overheating.

The leads 17 and 19 are of low electrical resistance, being for example, tinned copper wire of 2.5 $mm^2$ cross-sectional area. There is thus no risk of overheating in the connections to the bus bars and the amount of frit employed to provide base strips 12 and 13 for adhesion of the leads to the window require a minimum of the silver-containing, glass frit ink.

The spacing from the edge of the glass window of the strips 12 and 13, and the leads 17 which they carry depends on the design of the vehicle body and of the method of mounting of the window into that body. There must be a spacing of the strips 12 and 13 from the edge of the body or a metal trim for framing the window, and this has been found to be generally of the order of 10 mm to 30 mm in order to minimize stray capacitance, so that a useable radio signal can be derived.

In place of the circular section leads, such as the lead 17 shown in FIG. 2 the section of the tinned copper wire may be square or semi-circular, thereby providing a flat surface for better adhesion to the strips 12 and 13 by soldering or using a hot melt adhesive.

Figure 3:
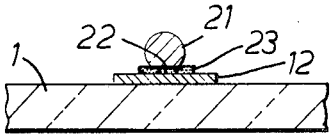
FIG. 3 is a section similar to FIG. 2 showing another form of lead.

FIG. 3 illustrates as lead 21 with a flat side 22 which is adhered to the strip 12 using a hot melt adhesive 23.

Figure 4:
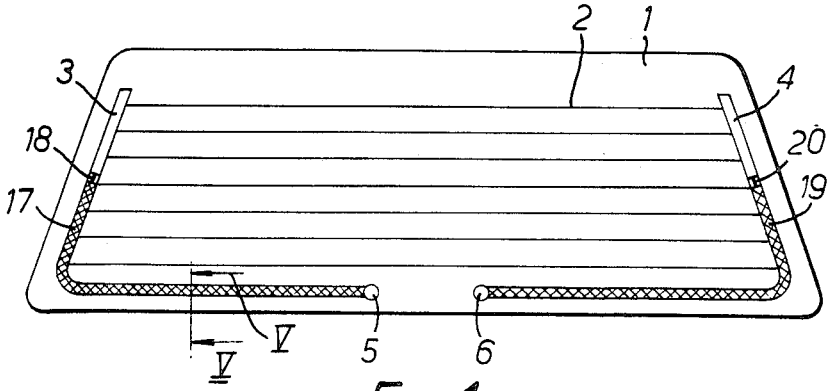
FIG. 4 is a view similar to FIG. 1 of another rear window with braided wire leads.
Figure 5:
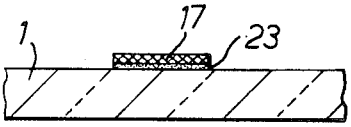
FIG. 5 is a section on line V—V of FIG. 4.

FIG. 4 illustrates a conventional rear window with bus bars 3 and 4 and an array of heating elements 2 extending between the bus bars. The leads 17 and 19 are flat braided copper leads which are connected to the connectors 18 and 20 and are adhered to the bus bars and directly to the glass using a hot melt adhesive 23 as shown in FIG. 5. The strips 12 and 13 are not present.

Further the leads may be insulated copper wire adhered directly onto the glass surface using a hot melt adhesive and adhered to the bus bars, using a similar adhesive, as they lead up to the connectors 18 and 20. Stranded leads could be used, each of which leads is incorporated in a self-adhesive sleeve which is used to adhere the lead to the glass.

The position of the terminals 5 and 6 and the disposition of the leads can be varied to suit any design. The terminals could for example be at the top of the rear window of a vehicle where necessary. Also the connections to the bus bars, for example by means of connectors 18 and 20 could be at the ends or anywhere along the bus bars. Such connectors could be dispensed with by employing leads which overlie the whole of each bus bar and soldering each lead to its bus bar at a position adjacent the end of each heating element of the heater array.

The spacing of the bus bars 3 and 4 from the side edges of the window, the spacing of the strips 12 and 13 and/or leads 17 and 19 from the edges of the window, and the spacing apart of the terminals 5 and 6 are adapted to suit the customer's requirements depending on the design of the body of the automobile into which the window is to be fitted, and to give optimum conditions for operation of the decoupling circuit 8, which decouples the radio frequency signal for feeding to the radio receiver 11, from the supply 9 of heating current from the battery of the automobile. When using the technique illustrated in FIGS. 1 and 2 with printed strips 12 and 13 for carrying the leads, all that is visible from outside the vehicle are the printed strips which form a part of the general heater pattern printed onto the glass surface.

Figure 6:
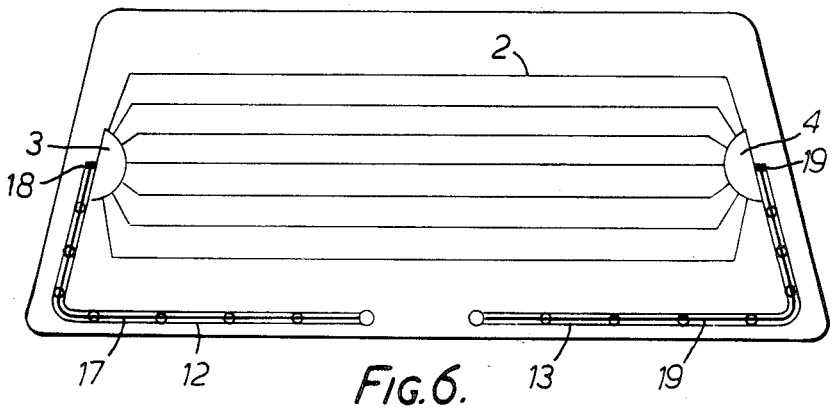
FIG. 6 is a view similar to FIG. 1 of another embodiment of the invention.

FIG. 6 illustrates another known heater array in which the heating elements 2 extend between semi-circular bus bars 3 and 4 which are printed centrally near each side of the window. The leads 17 and 19 are fixed to printed strips 12 and 13 in the same way as in the embodiment of FIGS. 1 and 2.

The invention thus provides a means for using a normal heater array printed onto a rear window of an automobile as a radio frequency aerial to provide a satisfactory radio signal decoupled from the other electrical circuits of the vehicle, without detracting from the appearance of the vehicle and with all the advantges of avoiding the need for an external aerial.

The glass window of the invention may be a heated windscreen having an array of heating elements or a conductive heating film. In a laminated window construction the array of heating elements or the heating film would usually be embodied within the laminate.

It will be appreciated by those of ordinary skill in the art that the present invention can be embodied in other specific forms without departing from the spirit or essential characteristics thereof. The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A glass window for a vehicle in combination with a heater/antenna arrangement which is supplied with heating current through a decoupling circuit that is operable to decouple the heating current supply from a radio signal that is derived from the heater/antenna arrangement and is fed through the decoupling circuit to an aerial input for a radio receiver of the vehicle, the heater/antenna arrangement comprising:

a pair of bus bars disposed at spaced locations on the window;

electrical resistance heating means extending between said spaced pair of bus bars;

a pair of terminals located on the window between said spaced bus bars and arranged near to the periphery of the window for connection to said decoupling circuit, said terminals being spaced from 50 mm to 300 mm apart;

a first low electrical resistance lead which is electrically connected to one of said terminals and to at least one point on one of said bus bars spaced from the ends of that bus bar; and a second low electrical resistance lead which is electrically connected to the other of said terminals and to at least one point on the other of said bus bars spaced from the ends of that bus bar;

said low electrical resistance leads being operable to carry both heating current from said terminals and a radio signal to said terminals, and being fixed to the surface of the window and positioned to provide low electrical resistance conductive paths on said window from said terminals to said bus bars, said paths being sufficiently spaced from the window edge to reduce any stray capacitance to a level such that a usable radio signal can be derived at said terminals for feeding through said decoupling circuit to said aerial input.

2. The combination of claim 1, wherein said terminals are positioned near the lower edge of said window and wherein said leads are positioned so as to be from 10 mm to 30 mm from an edge of the vehicle body or a metal trim for framing said window, when said window is installed in a vehicle.

3. The combination as claimed in claim 1 or claim 2, wherein said low electrical resistance leads are of copper.

4. The combination as claimed in claim 3, wherein each of said leads is a single strand copper wire adhered to a strip of frit fired onto said surface of the window.

5. The combination as claimed in claim 3, wherein each of said leads is a single strand copper wire having a flat side adhered to a strip of frit fired onto said surface of the window.

6. The combination as claimed in claim 3, wherein each of said leads is a flat braided copper wire lead adhered to said surface of the window.

7. A vehicle including in combination with a glass window as claimed in claim 1, a decoupling circuit connected to said terminals, a heating current supply circuit connected to said decoupling circuit, and a radio receiver having a signal input connected to a radio signal output from said decoupling circuit, said low electrical resistance conductive paths being sufficiently spaced from an edge of the vehicle body or metal trim framing the window that a usable radio signal is supplied by said decoupling circuit to said radio receiver.

8. In the combination of a glass window provided with a heater/antenna and a vehicle in which the glass window is mounted, wherein the vehicle has an aerial input for a radio receiver, an electrical power circuit for supply of heating current to the window, and a decoupling circuit which is connected to the electrical power circuit and to the aerial input for the radio receiver and which is operable to decouple the heating current supply from a radio signal that is derived from the heater/antenna and is fed through the decoupling circuit to the aerial input, the improvement in which the heater/antenna comprises:

a pair of bus bars disposed at spaced locations on opposite sides of the window;

electrical resistance heating means extending between said spaced pair of bus bars;

a pair of terminals located on the window between said spaced bus bars and arranged near to the periphery of the window, said terminals being spaced from 50 mm to 300 mm apart and being connected to said decoupling circuit;

a first low electrical resistance lead fixed to the window surface and electrically connected to one of said terminals and to at least one point on one of said bus bars spaced from the ends of that bus bar, said first lead extending in a path along the window periphery from said at least one point on said one bus bar to said one of said terminals;

a second low electrical resistance lead fixed to the window surface and electrically connected to the other of said terminals and to at least one point on the other of said bus bars spaced from the ends of that bus bar, said second lead extending in a path along the window periphery from said at least one point of said other of said bus bars to said other of said terminals;

said leads being operable to carry both heating current from said terminals and a radio signal to said terminals, and said paths of said leads being sufficiently spaced from the vehicle body or a metal trim framing the window to reduce stray capacitance so that a usable radio signal is derived at said terminals and supplied by said decoupling circuit to said aerial input for the radio.

9. The improvement of claim 8 wherein the spacing of said leads from the vehicle body or a metal trim framing the window is from 10 mm to 30 mm.

10. The improvement of claim 9 wherein said leads are copper leads.

11. The improvement of claim 8 wherein said leads are copper leads.

* * * * *